United States Patent [19]

Johanson

[11] 4,286,883

[45] Sep. 1, 1981

[54] BLENDING APPARATUS FOR BULK SOLIDS

[75] Inventor: Jerry R. Johanson, Chelmsford, Mass.

[73] Assignee: Jenike & Johanson, Inc., North Billerica, Mass.

[21] Appl. No.: 68,163

[22] Filed: Aug. 20, 1979

[51] Int. Cl.[3] ..... B01F 5/24

[52] U.S. Cl. ..... 366/137; 366/141; 366/183; 366/184; 366/192; 366/336; 366/341

[58] Field of Search ..... 366/9, 136, 137, 141, 366/150, 151, 159, 182, 183, 184, 336, 337, 341, 192

[56] References Cited

U.S. PATENT DOCUMENTS

| | | | |
|---|---|---|---|
| 1,224,656 | 5/1917 | McCandliss | 366/336 X |
| 1,415,830 | 5/1922 | Fredel et al. | 366/336 |
| 2,042,818 | 6/1936 | Allen et al. | 366/137 X |
| 3,423,076 | 1/1969 | Jacobs et al. | 366/337 |
| 3,583,681 | 6/1971 | Brown | 366/159 X |
| 3,912,231 | 10/1975 | Weber | 366/183 |
| 4,159,881 | 7/1979 | Gogneau | 366/337 |

FOREIGN PATENT DOCUMENTS

| | | | |
|---|---|---|---|
| 255331 | 1/1913 | Fed. Rep. of Germany | 366/9 |
| 2812092 | 10/1979 | Fed. Rep. of Germany | 366/341 |

*Primary Examiner*—Philip R. Coe
*Attorney, Agent, or Firm*—Kenway & Jenney

[57] ABSTRACT

Apparatus for blending bulk particulate solids comprises a distribution chute bin, a cone section having outer and inner cones, and a flow pattern controller outlet device. The solids may be recirculated from the outlet device to the chute bin for additional blending. The chute bin prevents particle size segregation by causing mixing of coarse and fine particles. The inner cone permits mass flow adjacent the outer cone, and also enforces the flow velocity profile imposed at the bottom of the cones to continue to the top of the inner cone. The flow pattern controller is operable to shift between a blending mode resulting from the difference in the velocity profiles within and around the inner cone and a uniform flow mode useful when emptying the apparatus.

26 Claims, 3 Drawing Figures

BLENDING APPARATUS FOR BULK SOLIDS

BRIEF SUMMARY OF THE INVENTION

Blending of large quantities of bulk particulate solids is generally accomplished as a batch process, in which a given quantity of the solids is placed in a container and agitated in various ways. One form of agitation consists in rotating the container, as in a double cone blender. Another form consists in rotating members within the container such as ribbons, vertical screws, paddle wheels or ploughs. A third method consists in directing blasts of fluid through the interior of the container to cause internal turbulence and fluidization of the solids.

A fourth method of agitating the solids consists in inducing flow patterns as the solids flow in the container by gravity, so as to cause material from various portions of the container to emerge from an outlet at the same time. The solids may be recirculated from the outlet back to the inlet of the container in order to improve the blending. The present invention relates generally to improvements in this fourth method of blending. Existing equipment of this type is satisfactory when used with nonsegregating free flowing bulk solid particulate materials such as uniformly sized plastic pellets. However, flow hangups may occur in such equipment when used with cohesive solids. Also, when such equipment is emptied of free flowing solids having a substantial size range, demixing often occurs.

With a view to overcoming the above and other limitations of existing blending apparatus of the type employing induced flow patterns of the solids, this invention is characterized by a number of features which, whether employed separately or in combinations, are adapted for blending a wide variety of bulk solids.

A feature of this invention comprises a distribution chute bin having a catch cylinder for receiving the material to be blended, a conical distribution chute upon which the material falls from the catch cylinder, and a cylindrical deflector plate surrounding and in spaced relation to the base of the chute for deflecting some of the particles falling therefrom. The catch cylinder and distribution chute are in spaced relationship, and means are provided to ensure the presence of material in the catch cylinder at substantially all times.

Another feature of the invention comprises a combination of outer and inner cones having surfaces thereof forming angles with the vertical, these angles being defined by limits that are functions of the mass flow characteristics of the material as hereinafter more fully described.

A further feature of the invention resides in a flow pattern control outlet section located below the inner and outer cones and adapted for controlling the degree of blending that results from the difference in the velocity profiles within the inner cone and between the cones. The flow control section comprises vertically movable parts adapted for shifting between a uniform flow mode adapted to prevent demixing of the material during emptying, and a blending mode resulting from the imposition of these differing flow profiles at the point of discharge.

DETAILED DESCRIPTION

Figure 1:
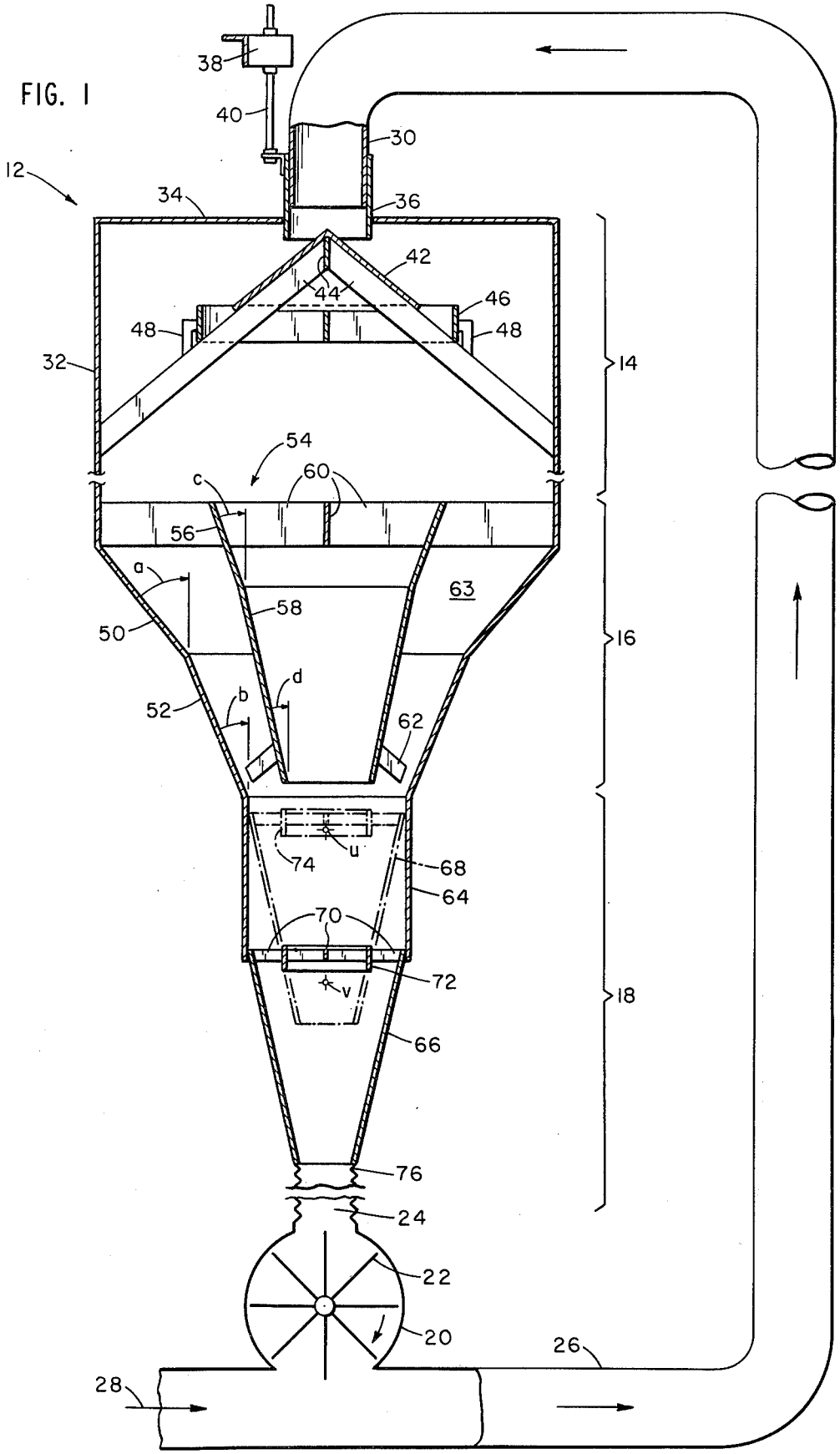
FIG. 1 is an elevation in section showing the preferred form of the blending apparatus.

Referring to FIG. 1, the preferred form of the blending apparatus is designated generally at 12 and comprises a distribution chute bin 14, a cone section 16 and a flow pattern controller outlet device 18. A rotary valve 20 comprising a cylindrical housing and a paddle wheel 22 of conventional construction delivers material from a discharge opening 24 to a conventional pneumatic conveyor line 26. Air under pressure is delivered from a source (not shown) to the line 26 in the direction of an arrow 28. The material delivered into the line from the rotary valve is thus delivered to and through a cylindrical duct 30 for recirculation to the apparatus 12.

If desired, the line 26 may deliver the blended material to any other desired location, instead of recirculating it to the blending apparatus. This is determined by the degree of blending required, and is a function of the degree of blending achieved on a single pass of the material through the blending apparatus.

Referring more particularly to the structure of the blending apparatus, a bin is formed with a cylindrical section 32, preferably closed by a top cover 34 having a central opening. An adjustable catch cylinder 36 is slidable between the opening in the cover 34 and the cylindrical duct 30. A pneumatic control cylinder 38 of conventional form has a rod 40 connected by a bracket to the catch cylinder 36. The control 38 is adapted for continuous adjustment of the height of the cylinder 36 between predetermined upper and lower limits. If desired, the control 38 may be adapted to cause the cylinder to reciprocate periodically.

Within the bin is located a conical distribution chute 42 preferably formed of sheet metal and supported by four metal struts or plates 44 joined at the apex or vertex of the chute in mutually right angular relationship and extending to the wall of the bin 32. The surface of the chute 42 forms an angle with the horizontal that exceeds the surface friction angle between the surface and the solids to be blended. For this purpose the "surface friction angle" means the angle of slide, that is, the minimum angle permitting the weight of the solids on the surface to overcome the frictional force tending to prevent them from sliding thereon down the chute.

A cylindrical deflector plate 46 is supported by brackets 48 on the struts 44 in concentricity with the chute 42, and is spaced radially outwardly of the base of the chute. The deflector plate functions in combination with the chute to prevent particle size segregation, as follows.

When aggregates comprising a range of particle sizes are delivered on to the chute 42, segregation tends to occur because of the difference in the coefficient of friction between the coarse particles and the fine particles. Thus the coarse particles generally have a lower coefficient of friction than the fines and will have a trajectory above that of the fines as the material reaches the lateral position of the deflector plate 46. The plate position is adjusted vertically to cause the coarse particles to be deflected by it in an inward and downward direction, while the fines continue their outward trajectory beneath the lower edge of the deflector plate. The coarse and fines are thus forced to collide and to cause a degree of mixing.

Attached to the bottom of the bin 32 is an outer cone 50 having a frustoconical closed annular inwardly and downwardly sloping interior surface forming an angle "a" with the vertical. Similarly, an outer cone 52 connected to the base of the cone 50 has a frustoconical closed annular inwardly and downwardly sloping interior surface forming an angle "b" with the vertical.

Within the outer cones 50 and 52 is supported an insert structure designated generally at 54 and comprising inner cones 56 and 58. The insert structure is supported by four struts or plates 60 joined at the axial line of the distribution chute and extending to the bin section 32. Three spaced braces 62 also extend from the base of the inner cone 58 to the outer cone 52 to maintain a coaxial relationship between the inner cones and the outer cones. The cone 56 has a frustoconical closed annular inwardly and downwardly sloping wall that forms an angle "c" with the vertical and the cone 58 also has a frusto-conical closed annular inwardly and downwardly sloping wall that forms an angle "d" with the vertical.

In the illustrated embodiment the cones 50, 52, 56 and 58 are all frustoconical right circular cones, and each has its apex lying in the vertical axis of the distribution chute, this axis being referred to herein as the central axis of the blender. That is, if the surface of each of the cones 50, 52, 56 and 58 were extended to its apex, such apex would lie in the central axis of the blender. Moreover, in the embodiment as shown, the apexes of the cones 50 and 56 are coincident in one point "u" on this central axis, and the apexes of the cones 52 and 58 are coincident in a second point "v" on this central axis.

The magnitudes of the angles "a", "b", "c" and "d" have certain relationships related to the condition of "mass flow," as described in U.S. Pat. No. 3,797,707 dated Mar. 19, 1974, issued to Andrew W. Jenike and the present applicant, and also described elsewhere in the prior art. In general, "mass flow" is a condition in which all of the solid material within the hopper is in motion whenever any of it is drawn out. In the design of any hopper of conical configuration, it may be empirically determined that there is a certain angle, termed the "mass flow angle" measured between the interior surface and the vertical, below which a given material will exhibit mass flow and above which it will not.

In the described embodiment, each of the angles "c" and "d" is less than the mass flow angle for the particular solids to be blended. Also, the included angles whose magnitudes are the differences (a–c) and (b–d) are each less than the same mass flow angle. Under these conditions, mass flow of the solids occurs both within the insert structure 54 and in the annulus 63 between the structure 54 and the outer cones 50 and 52.

It has been determined that certain requirements, which are satisfied by the above-described embodiment, must be satisfied in order to achieve mass flow both within the insert structure and within the annulus 63. These requirements are the following:

(1) None of the angles "c" or "d" or the differences (a–c) or (b–d) may exceed the mass flow angle.

(2) The surfaces of the cones 50 and 52 must each have a greater slope than the surface friction angle for the particular solids.

(3) The entire surface of the cone 50 must lie within an angle equal to the mass flow angle subtended between the cone 56 and a hypothetical cone having a common apex point with the cone 56. Similarly, the entire surface of the cone 52 must lie within an angle equal to the mass flow angle subtended between the cone 58 and a hypothetical cone having a common apex point with the cone 58.

If the above conditions are met, it is not necessary that either of the angles "a" or "b" be less than the mass flow angle. This can result in a distinct advantage in cases where the angles "a" or "b" exceed the mass flow angle, for in such cases the material flowing toward the outlet 24 would not exhibit mass flow characteristics in the absence of the insert structure 54. Also, it is not necessary that the apexes of the cones 50 and 56 be coincident in the point "u" or that the apexes of the cones 52 and 58 be coincident in the point "v." The above-described conditions can be met, for example, in cases where the apex of the cone 50 is either above or below that of the cone 56 on the central axis, or where the apex of the cone 52 is either above or below that of the cone 58 on the central axis.

The insert structure 54 performs an additional function, namely, blending of the solids that results from the difference between the flow velocity profile within the insert structure and the flow velocity profile in the annulus 63 between the insert structure and the outer cones. The flow velocity profile within the inner cone 58, for example, is such that the solids move somewhat more slowly along or adjacent the inner surface of the cone than in the central region. Moreover, the velocity distribution is a function of the slope of the cone surface. Likewise, the velocity of the solids adjacent the surface of the cone 52 is lower than that of the solids near the outer surface of the cone 58. The ratio between the average velocities within the inner cone 58 and within the outer annulus 63 between the cones 52 and 58 is determined (as described below) by the velocity imposed at the top of the cylinder 64 where it is joined to the cone 52. This feature allows the blending action to be adjusted to minimize the amount of recycling necessary to achieve the desired degree of blending. It may also allow the adjustment of flow patterns so that the average velocities of the inner and outer regions are equal, thus causing a first-in-first-out sequence of solids flow which prevents demixing during emptying of the blender.

In the embodiment shown, there are two outer cones 50 and 52, and two corresponding inner cones 56 and 58 respectively. Alternatively, only one outer cone and one corresponding inner cone may be used, in which case, the same requirements for mass flow described above apply with respect to the angles and location of the sloping surfaces. Thus for example, the inner surface of the inner cone forms an angle with the vertical that is smaller than the mass flow angle for the particular type of cone surface and bulk material in use. Likewise, the difference between the angles which each of the cone surfaces subtends with the vertical is less than the mass flow angle, although the angle between the inner surface of the outer cone and the vertical may or may not exceed the mass flow angle.

Likewise, the outer cone structure may comprise three or more cone sections, in which case the insert cone structure has a corresponding number of cone sections, each corresponding to one of the outer cone sections and satisfying the criteria described above.

As shown in the drawing, the lowermost end of the outer cone 50 is somewhat lower than the lowermost end of the corresponding inner cone 56. In cases where the angle "a" exceeds the mass flow angle, the cone 50 should not extend downwardly below an arc struck about the common apex point "u" and passing through the lowermost end of the cone 56; otherwise the cone 56 will be ineffective to ensure mass flow along the lower end of the cone 50. Thus any portion of the outer cone that extends below this arc should form an angle with the vertical that is less than the mass flow angle. Similar conditions apply, of course, to the cones 52 and 58, in which case the arc defining the lower limit of the cone 52 is struck about the common apex point "v" and passes through the lowermost end of the cone 58.

In the described embodiment the bulk material flows within the insert cone structure as well as between the inner and outer cones. This embodiment is useful because it provides a blending action as described above. In an application where this blending action is not required, the above-described insert cone structure may still be useful in cases where an outer cone forms an angle with the vertical that exceeds the mass flow angle. In such cases, as described above, mass flow can still be produced if an insert structure is provided so that the difference between the angles, which the inner surface of the outer cone and the outer surface of the insert structure subtend with the vertical, is less than the mass flow angle. For this purpose it is not necessary that material flow through the insert structure, and this structure may be provided with a cover either in the form of the distribution chute 42 or in some other suitable form. Since no material flows through the insert structure in such embodiment, it is immaterial whether or not the interior surface forms an angle with the vertical that exceeds the mass flow angle. Thus it is possible to have mass flow around a closed insert structure under conditions in which the inner surface of the outer cone and the outer surface of the insert structure both form angles with the vertical that exceed the mass flow angle. It is believed that the prior art has hitherto failed to recognize that in embodiments having an insert structure, mass flow is achieved when the difference between the angles, as described above, is less than the mass flow angle, the latter angle being ascertained by conventional methods in a hopper having no insert structure.

In the above-described embodiment, each of the inner and outer cones is a right circular cone. Preferably, the cones 50 and 56 have a common apex "u"; likewise, the cones 52 and 58 have a common apex "v". However, the invention is not limited to right circular cones. The word "cone" as used herein and in the appended claims is intended to be defined by the broader definition, which is any surface generated by a straight line (generator) passing through a point (vertex) and points on a closed curve (directrix) that lies in a horizontal plane, the directrix being of circular, elliptical, pyramidal or other polygonal form, or in any other closed curve or composite shape that is convenient for purposes of fabrication or spatial considerations. It will be recognized that in any of these cases the above-described requirements, as to surface location and the angles subtended between the surfaces or formed between such surfaces and the vertical, apply to each portion of such surfaces of each outer cone and to the most nearly contiguous portion of the surface of the associated inner cone.

The construction of the flow pattern controller 18 is next described. This includes a cylindrical section 64 joined to the bottom of the outer cone 52. A mass flow hopper 66 is vertically slidable within the section 64 between a lower extremity position shown in solid lines and an upper extremity position designated 68 and shown in broken lines. By "mass flow hopper" is meant a conical hopper having an inner surface forming an angle with the vertical that is less than the mass flow angle. Four struts 70 support a cylindrical flow control sleeve 72 coaxially within the hopper 66 at its upper extremity. The diameter of the sleeve 72 is approximately equal to the diameter of the opening at the bottom of the inner cone 58. The flow pattern controller changes the ratio of the average velocity within the inner cone to the average velocity within the outer annulus, as follows.

If a maximum average velocity within the inner cone is desired, the cone 66 and the attached sleeve 72 are moved to the upper extremity position. Since the mass flow cone 66 itself has an inherent flow velocity profile or pattern with the velocity faster in its central region and slower at its wall, this same pattern is imposed at the bottom of the cone 52 where it is joined to the cylinder 64. Therefore, most of the material moving at the faster rate through the cone 66 will be material from within the inner cone and most of the material moving at the slower rate through the cone 66 will be material from the outer annulus. This means that materials arriving at the top of the insert structure and the top of the annulus at the same time will arrive at the bottom of the cone 66 at different times, and the net effect will be a blending of the materials.

If a more uniform velocity distribution at the bottom of the cone 52 is desired, the assembly comprising the cone 66 and the sleeve 72 is lowered to cause a vertical separation between the bottom of the cone 52 and the top of the cone 66. This vertical separation smoothes out and makes more uniform the velocity flow pattern across the region of the cylinder 64 between the cones 66 and 52. If this separation is sufficient a uniform velocity is imposed at the bottom of the cone 52.

Generally, therefore, the maximum degree of blending occurs when the hopper 66 is in its uppermost position, and substantially no blending occurs when it is in its lowermost position. However, in the lowermost position a uniform velocity profile is imposed on the material flowing through the hopper 66, and this uniform pattern is therefore imposed upon all material flowing above it to the top of the bin.

In order to permit the vertical movement of the hopper 66, a bellows 76 is attached between the bottom of the hopper and the rotary valve housing 20.

In operation, a quantity of bulk solids to be blended is fed into the blending apparatus 12 from a source (not shown), preferably through the line 26. The vertical spacing between the catch cylinder 36 and the distribution chute 42 is either adjusted or varied periodically in a reciprocating motion so that there is constantly a quantity of material in the catch cylinder. The rate at which the material falls on to the distribution chute is determined by this spacing. For blending purposes, the hopper 66 is in its uppermost position. The distribution chute and the deflector plate 46 functions as described above to cause blending of coarse and fine particles, which then fall either into the insert structure 54 or the annulus 63 between the insert structure and the outer cones. Blending occurs in the hopper 66 due to the difference in the average velocities of the material flowing within and around the insert structure. The material is readmitted to the line 26 and recirculated or recycled to the catch cylinder for additional blending.

If it is desired to empty the blending apparatus 12, the hopper 66 is lowered to the position shown in solid lines, and the material may then be withdrawn without demixing due to the uniform flow pattern imposed.

Figure 2:
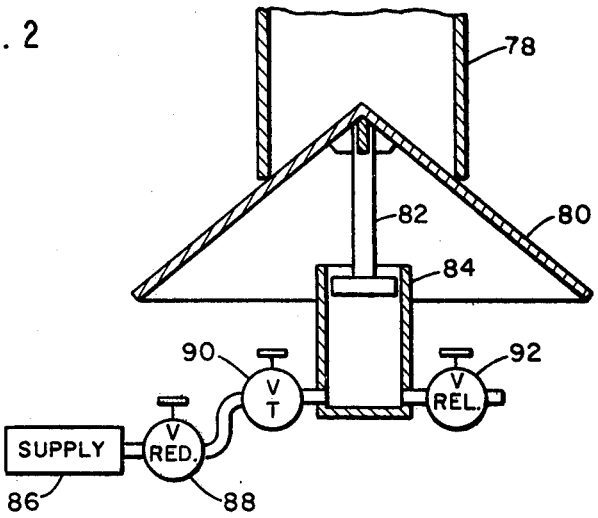
FIG. 2 is an elevation in section of an alternative form of the distribution chute bin.

In the above-described embodiment, the spacing between the catch cylinder 36 and the distribution chute 42 is varied by vertical movement of the catch cylinder. An alternative embodiment is shown in FIG. 2, in which a catch cylinder 78 is fixed and may be simply an extension of the duct 30. A conical distribution chute 80 is supported on a piston 82 sliding in a fixed cylinder 84. A source 86 of pneumatic or hydraulic pressure is connected through a regulator 88 and a needle valve 90 to the cylinder. A pressure relief valve 92 is also connected to the cylinder. The regulator 88 is set to produce a pressure level within the cylinder that is sufficient to support the weight of the distribution chute 80 bearing with light pressure on the end of the catch cylinder 78 when there is substantially no material in the catch cylinder. When material is then added to the catch cylinder, the force upon the piston 82 increases the pressure within the cylinder 84 above this level. The relief valve 92 is set to open when the pressure exceeds the level that exists when the catch cylinder is filled with material. The relief valve 92 resets once the pressure has dropped. The needle valve 90 controls the rate of lift of the chute whenever the pressure within the cylinder is below the level determined by the setting of the regulator 88.

Figure 3:
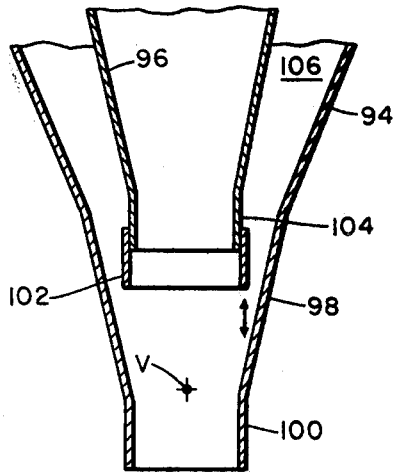
FIG. 3 is an elevation in section of an alternative form of the flow pattern controller.

FIG. 3 shows an alternative embodiment of the flow control section of the blending apparatus. In this embodiment there is provided an outer cone 94, an inner cone 96, a fixed mass flow hopper 98 and a discharge fitting 100. A cylindrical flow control sleeve 102 is vertically adjustably slidable on a cylindrical section 104 extending from the bottom of the inner cone 96 to control the extent of its deflection of material flowing in the annulus 106. This controls the degree of blending in a manner similar to the movement of the flow control sleeve 74 described in connection with FIG. 1. In this embodiment, since the hopper 98 is fixed, a degree of blending will occur under all conditions, which may be sufficient in applications where a uniform flow pattern upon discharge is not required.

I claim:

1. Blending apparatus for bulk solids comprising particles of coarse and fine sizes, including the combination of a bin having discharge means, a conical distribution chute with a downwardly and outwardly sloping wall situated within the bin and having a greater coefficient of friction with the fine particles than with the coarse particles, a deflector plate supported coaxially with the chute and within the bin and having a cylindrical interior surface spaced radially outwardly of the base of the chute, and a catch cylinder supported coaxially with and above the chute in position to direct said solids falling therefrom on to said sloping wall, whereby the fine particles fall from said sloping wall in a lower trajectory than that of the coarse particles as a result of said different coefficients of friction, the deflector plate having its lowermost extremity above the trajectory of the fine particles and extending vertically from said extremity a sufficient distance to intersect the trajectory of the coarse particles so as to deflect the coarse particles while permitting the fine particles to fall undeflected therebeneath, whereby the coarse and fine particles are caused to collide.

2. Apparatus according to claim 1, including a conveyor line connected between the catch cylinder and the discharge means to recirculate solids from the discharge means to the catch cylinder.

3. Apparatus according to claim 2, including a valve connected between the discharge means and the conveyor line and operative to deliver the solids to said conveyor line at a rate sufficient to cause the catch cylinder to contain solids substantially continuously during the recirculation thereof.

4. Apparatus according to claim 1, in which the slope angle of the wall of the chute exceeds the surface friction angle for the chute surface and said solids.

5. Apparatus according to claim 1, with feed control means for varying the axial spacing between the lower end of the catch cylinder and the surface of the chute.

6. Apparatus according to claim 5, in which the feed control means include a control connected and operative to impart an oscillatory axial relative movement between the catch cylinder and the chute.

7. Apparatus according to claim 5, including a cylindrical duct above the chute, the catch cylinder being fittingly slidable on the duct, and means for varying the vertical position of the catch cylinder on the duct.

8. Blending apparatus for bulk solids comprising particles of different sizes, including the combination of a bin having discharge means, an outer cone having a frustoconical closed annular inwardly and downwardly sloping interior surface forming a first angle with the vertical, an inner cone coaxially supported within the outer cone and having a closed annular inwardly and downwardly sloping exterior surface forming a second angle with the vertical which is smaller than said first angle, the difference between the first and second angles being less than the mass flow angle for said solids, a conical distribution chute with a downwardly and outwardly sloping wall situated within the bin and above the inner cone, a deflector plate supported coaxially with the chute and within the bin and having a cylindrical interior surface spaced radially outwardly of the base of the chute, and a catch cylinder supported coaxially with and above the chute in position to direct said solids falling therefrom on to said sloping wall.

9. Apparatus according to claim 8, in which the bin has a section above and connecting with the outer cone and the chute and deflector plate are supported within said section and above the inner cone.

10. A bin for bulk particulate solids having, in combination, an outer cone having a frustoconical closed annular inwardly and downwardly sloping interior surface forming a first angle with the vertical, a cylindrical section connecting with the lower extremity of said surface, an inner cone coaxially supported within the outer cone and having a closed annular inwardly and downwardly sloping exterior surface forming a second angle with the vertical which is smaller than said first angle, means for directing a flow of particulate solids into the annulus formed by the outer and inner cones, the first angle being greater and the difference between the first and second angles being less than the mass flow angle for said solids, and discharge means connecting with the lower end of the cylindrical section comprising a hopper having an inwardly and downwardly sloping surface forming an angle with the vertical which is less than the mass flow angle for said solids.

11. A bin according to claim 10, in which the inner and outer cones are right circular cones.

12. A bin according to claim 10, in which the directrices of the inner and outer cones are polygons.

13. A bin according to claim 10, in which the inner and outer cones have a common apex.

14. A bin according to claim 13, in which said surface of the outer cone lies entirely above an arc struck about said common apex and passing through the lowermost extremity of the inner cone.

15. A bin according to claim 10, in which said surface of the outer cone lies entirely within an angle equal to said mass flow angle formed between said surface of the inner cone and a conical surface having a common apex point with the inner cone.

16. A bin according to claim 10, in which the inner cone is open at its upper and lower extremities and has a closed annular inwardly and downwardly sloping interior surface forming an angle with the vertical that is less than the mass flow angle for said solids.

17. A bin according to claim 16, in which said means directs a flow of particulate solids simultaneously into said annulus and the inner cone.

18. Blending apparatus for bulk solids comprising particles of different sizes, including the combination of a bin having discharge means, a conical distribution chute with a downwardly and outwardly sloping wall situated within the bin and supported for vertical movement, a deflector plate supported coaxially with the chute and within the bin and having a cylindrical interior surface spaced radially outwardly of the base of the chute, a catch cylinder supported coaxially with and above the chute in position to direct said solids falling therefrom on to said sloping wall, and feed control means responsive to a weight of solids on the chute exceeding a predetermined value to lower the chute.

19. Apparatus according to claim 18, including vertically extensible piston and cylinder means supporting the chute, the feed control means including a source of fluid pressure connected to the cylinder and adapted to apply a pressure thereto sufficient to support the chute with the catch cylinder empty, and relief valve means to release fluid from the cylinder when the force on the piston exceeds the sum of the weights of the chute and a predetermined quantity of solids in the catch cylinder.

20. A bin for bulk particulate solids having, in combination, an outer cone having a frustoconical closed annular inwardly and downwardly sloping interior surface forming a first angle with the vertical and having discharge means connecting with its lower end, and an inner cone coaxially supported within the outer cone and having a closed annular inwardly and downwardly sloping exterior surface forming a second angle with the vertical which is smaller than said first angle, the difference between the first and second angles being less than the mass flow angle for said solids, said inner and outer cones each comprising a plurality of connecting frustoconical sections of which the surfaces form differing angles with the vertical.

21. A bin for bulk particulate solids having, in combination, an outer cone having a frustoconical closed annular inwardly and downwardly sloping interior surface forming a first angle with the vertical, an inner cone coaxially supported within the outer cone and having closed annular inwardly and downwardly sloping exterior and interior surfaces each forming a second angle with the vertical, said second angle and the difference between the first and second angles both being less than the mass flow angle for said solids, and discharge means including a hopper having an inwardly and downwardly sloping interior surface forming an angle with the vertical that is less than the mass flow angle for said solids, and including means to raise and lower the hopper in relation to the lower extremity of the inner cone.

22. A bin for bulk particulate solids having, in combination, an outer cone having a frustoconical closed annular inwardly and downwardly sloping interior surface forming a first angle with the vertical, an inner cone coaxially supported within the outer cone and having closed annular inwardly and downwardly sloping exterior and interior surfaces forming a second angle with the vertical, the inner cone having a sleeve vertically adjustably extending from its lower extremity, said second angle and the difference between the first and second angles both being less than the mass flow angle for said solids, and discharge means including a hopper connecting with the lower end of the outer cone radially outwardly of the sleeve and having an inwardly and downwardly sloping interior surface forming an angle with the vertical that is less than the mass flow angle for said solids.

23. A bin for bulk particulate solids having, in combination, an outer cone having a frustoconical closed annular inwardly and downwardly sloping interior surface forming a first angle with the vertical, a cylindrical section connecting with the lower extremity of said surface, and discharge means connecting with the lower end of the cylindrical section, an inner cone coaxially supported within the outer cone and having a closed annular inwardly and downwardly sloping exterior surface forming a second angle with the vertical which is smaller than said first angle, and means for directing a flow of particulate solids simultaneously into the inner cone and the annulus formed by the outer and inner cones, the difference between the first and second angles being less than the mass flow angle for said solids.

24. A bin according to claim 23, in which the discharge means comprise a hopper having an inwardly and downwardly sloping surface forming an angle with the vertical which is less than the mass flow angle for said solids.

25. A bin for bulk particulate solids having, in combination, an outer cone having a frustoconical closed annular inwardly and downwardly sloping interior surface forming a first angle with the vertical, discharge means comprising a conical hopper having an inwardly and downwardly sloping surface contiguous at the upper extremity with the lower extremity of the outer cone and forming an angle with the vertical which is less than the mass flow angle for said solids, an inner cone coaxially supported within the outer cone and having a closed annular inwardly and downwardly sloping exterior surface forming a second angle with the vertical which is smaller than said first angle, and means for directing a flow of particulate solids, simultaneously into the inner cone and the annulus formed by the outer and inner cones, the difference between the first and second angles being less than the mass flow angle for said solids.

26. A bin for bulk particulate solids having, in combination, an outer cone having a frustoconical closed annular inwardly and downwardly sloping interior surface forming a first angle with the vertical and having discharge means including a hopper connecting with its lower end, said hopper having an inwardly and downwardly sloping interior surface forming an angle with the vertical that is less than the mass flow angle for said solids, an inner cone coaxially supported within the outer cone, open at its upper and lower extremities, having a closed annular inwardly and downwardly sloping exterior surface forming a second angle with the vertical which is smaller than said first angle, having a closed annular inwardly and downwardly sloping interior surface forming an angle with the vertical that is less than the mass flow angle for said solids, and a sleeve vertically adjustably extending from its lower extremity, the hopper connecting with the lower end of the outer cone radially outwardly of the sleeve, and means for directing a flow of particulate solids into the annulus formed by the outer and inner cones, the first angle being greater and the difference between the first and second angles being less than the mass flow angle for said solids.

* * * * *

UNITED STATES PATENT AND TRADEMARK OFFICE

CERTIFICATE OF CORRECTION

PATENT NO. : 4,286,883

DATED : September 1, 1981

INVENTOR(S) : Jerry R. Johanson

It is certified that error appears in the above-identified patent and that said Letters Patent are hereby corrected as shown below:

Column 12, add the following claim:

--27. A bin according to claim 21 including a sleeve supported coaxially in fixed relation to the hopper in position to receive the solids from the inner cone when the hopper is in an upper limit position.--

Signed and Sealed this

*Eighth* Day of *December 1981*

[SEAL]

*Attest:*

GERALD J. MOSSINGHOFF

*Attesting Officer*

*Commissioner of Patents and Trademarks*